United States Patent [19]

Cohen

[11] 3,938,706

[45] Feb. 17, 1976

[54] MECHANICAL FLUID AND PASTE DISPENSER

[76] Inventor: Milton J. Cohen, 9201 Persimmon Tree Road, Potamac, Md. 20854

[22] Filed: Aug. 27, 1973

[21] Appl. No.: 392,089

Related U.S. Application Data

[63] Continuation-in-part of Ser. No. 308,548, Nov. 21, 1972, abandoned.

[52] U.S. Cl. ..... 222/83.5; 222/95; 222/105

[51] Int. Cl.[2] ..... B65D 35/20

[58] Field of Search ..... 222/390, 391, 541, 83, 222/83.5, 95, 105

[56] References Cited

UNITED STATES PATENTS

| | | | |
|---|---|---|---|
| 194,706 | 8/1877 | Mentzel | 222/390 |
| 1,668,511 | 5/1928 | McLaughlin | 222/391 X |
| 2,477,875 | 8/1949 | Hutchason | 222/326 X |
| 3,642,172 | 2/1972 | Malpas | 222/541 X |

FOREIGN PATENTS OR APPLICATIONS

| | | | |
|---|---|---|---|
| 204,082 | 7/1939 | Switzerland | 222/390 |
| 386,298 | 4/1931 | United Kingdom | 222/95 |
| 850,458 | 12/1939 | France | 222/391 |

*Primary Examiner*—Robert B. Reeves
*Assistant Examiner*—John P. Shannon

[57] ABSTRACT

A fluid or paste dispenser in which use is made of a housing embodying the content material, with the bottom wall of the housing being displaceable axially relative to the housing for pressurizing the content material within the bag.

2 Claims, 3 Drawing Figures

MECHANICAL FLUID AND PASTE DISPENSER

This is a continuation-in-part of my copending application Ser. No. 308,548, filed Nov. 21, 1972, and entitled "Bag Type Fluid Dispenser and Method for Loading the Same", and now abandoned.

This invention relates to a non-aerosol type fluid or paste dispenser, which makes use of mechanical pressure generated by a flexible bag for ejection of the paste or fluid in response to release by a manually operable valve.

In the aforementioned copending application, description is made of a rigid dispensing container having a flexible diaphragm secured at its periphery to the open upper end of the container. The container is subsequently sealed by a closure fitted with a dispensing valve. The diaphragm is stretched to substantially line the inner wall of the container and it is retained in the stretched condition by a latching means provided in the bottom wall of the container, releasably to grip an element projecting from the bottom side of the diaphragm when the diaphragm is in stretched position.

Fluid or paste material, to be dispensed from the container, is introduced into the interior of the stretched diaphragm through the open upper end of the container, in an amount substantially to fill the container. Thereafter, the cover is mounted in sealed relation to close the upper end of the container, to complete the dispensing package in which the fluid or paste to be dispensed is housed in sealed relation within the container but without subjecting the material to pressure.

The filled container can be stored, shipped, or displayed in the pressureless state thereby to avoid loss due to leakage, marring the appearance of the container due to leakage of content material, or danger of explosion due to internal pressures.

When it is desired to place the container into operation for dispensing content material, the latch is operated from the outside to release its grip on the diaphragm thereby to release the stretched diaphragm for normal return to its relaxed position. Thus the diaphragm becomes effective to impose pressure on the fluid or paste contained therein whereby such fluid or paste is ejected from the container in response to the operation of the valve and in amounts controlled thereby.

It is an object of this invention to provide a fluid and paste dispenser of the type described in which the fluid or paste can be maintained in a pressureless state and can be placed under pressure by mechanical means to pressurize the material for ejection under control of the dispensing valve, and in which the pressurization can be achieved incrementally until the whole of the fluid or paste has been dispensed.

Figure 1:
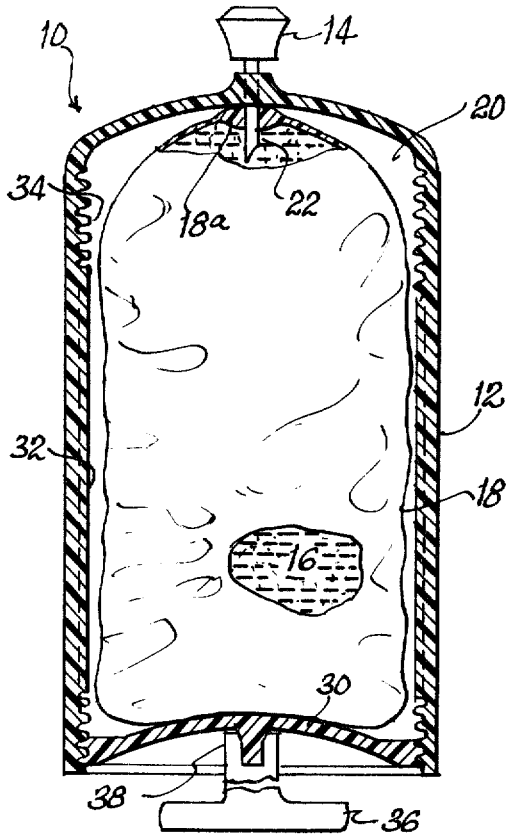
Figure 2:
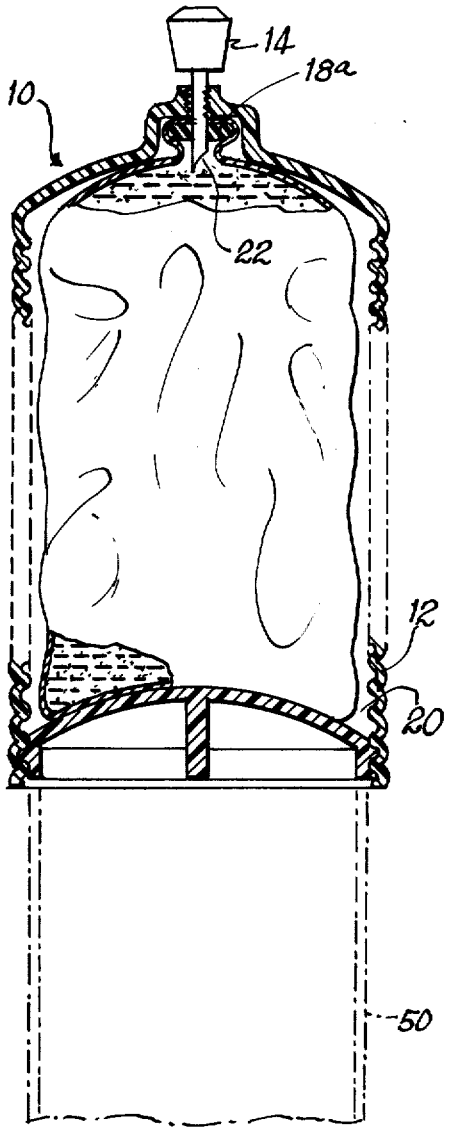
Figure 3:
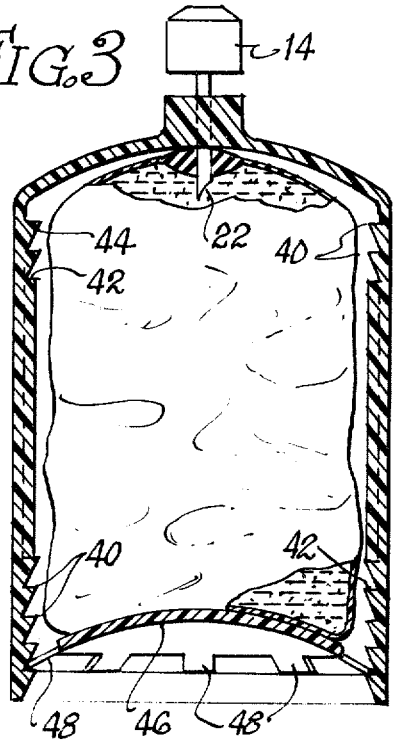

These and other objects and advantages of this invention will hereinafter appear and, for purposes of illustration, but not of limitation, embodiments of the invention are shown in the accompanying drawing in which FIG. 1 is a schematic sectional elevational view of a dispenser embodying the features of this invention;

FIG. 2 is a sectional elevational view of a modification of the construction shown in FIG. 1; and FIG. 3 is a schematic sectional elevational view similar to that of FIG. 1 showing modification in the mechanical pressurizing means.

Referring now to the drawing, the dispenser 10 is formed of a rigid housing 12 which is open at the bottom and closed at the top. The housing can be of various shapes, such as square, rectangular, oval, or polygonal in cross section, but it is preferred to make use of an elongate housing of cylindrical shape. The housing can be constructed of conventional structural materials, such as metal, tin or tin-plate, aluminum, or of plastic material, or of a laminate of plastics, metal, and/or paper.

A dispensing valve 14 is provided in the top wall of the housing. The dispensing valve is of conventional construction, such as employed for dispensing pressurized fluid or paste from an aerosol can.

The fluid or paste 16 to be dispensed is provided as a package in a deformable flexible bag 18 formed of a material which is substantially impervious to the content material or fluids or vapors contained therein. For example, the bag can be formed of a rubber-like material, such as natural rubber, synthetic rubber, or it can be formed of a flexible plastic such as polyethylene, polypropylene, polyvinyl homopolymer, or copolymer with styrene and/or acrylonitrile, polyester, polyamides, and the like, or of a metal-plastic-paper laminate in a bag which is foldable or collapsible, as an accordion.

The interior 20 of the housing is dimensioned to receive the filled bag in substantially fitting relation therein. Communication between the fluid or paste within the bag and the dispensing valve 14 is effective by means of a hollow tubular member, such as a hollow needle 22 which extends downwardly from the valve into position to pierce the bag 18, when in position of use within the container. The bag 18 is adapted to be joined to the valve in a sealing relation to prevent emission of content material other than through the needle, when the material within the bag is in a pressurized state. For this purpose, the pierced end portion 18$^{a}$ of the bag 18 is of greater thickness for reinforcement and for a better gripping relation with the tubular member.

The fluid or paste material 16 within the bag 18 is adapted to be pressurized within the housing, as by means of a disc plate 30 having portions which extend laterally into engagement with the inner wall 32 of the housing, throughout the body portion. Means are provided in the portion of the inner wall of the housing, engageable by the disc plate, to enable axial displacement of the disc plate 30 to within the body portion of the housing from an initial lower position to an upper exhausted position within the housing.

In one embodiment, illustrated in FIG. 1, the interior wall of the body portion of the housing is formed substantially throughout its length with screw threads 34, which are threadably engaged by the portion of the disc plate which extends into engagement with the wall. The disc plate is provided on its bottom side with a turning key 36, which may be mounted on the lower end of an extensible rod 38 so as to be accessible from beyond the bottom of the housing to effect turning movement.

While the disc plate 30 can be formed of a central portion of smaller dimension than the opening in the bottom wall, with arms extending radially outwardly — preferably diametrically — into engagement with the threaded inner wall 34 of the body portion of the housing, it is preferred to provide a disc plate dimensioned to correspond to the cross section of the body portion of the housing thereby to function as a bottom wall for the housing as well as an actuator.

In operation, the bag 18 filled with fluid or paste 16 is introduced through the open bottom side into the body portion of the housing. Thereafter, the disc plate 30 is assembled onto the container to close the open bottom side, as by threadably engaging the disc plate with the threaded inner wall portion of the housing and by turning the disc plate a few turns merely to locate the disc plate in the lower portion of the housing.

In this condition, the loaded dispenser can be packaged, shipped, displayed, and stored without the fluid or paste being in a pressurized state. When it is desired to make use of the fluid or paste, the key 36 is turned in a direction to screw the disc plate 30 for movement upwardly into the body portion of the housing responsive to engagement with the threaded interior of the housing.

Such turning movement is continued until the disc plate 30 engages the bottom side of the bag 18 by an amount to build up the desired pressurized state within the fluid or paste material. Thereafter, fluid or paste can be dispensed in response to valve operation until the pressure drops to undesirable levels. Repressurization can be achieved by further turning movement of the key 36 and disc plate 30 for further displacement of the disc plate up into the housing whereby the bag is again placed under compression sufficient to pressurize the remaining content material. The incremental dispenser and pressurization steps can be repeated until the disc plate has been displaced to its upper position of adjustment, at which time it is anticipated that the content material will have been exhausted from the bag.

If desired, the dispenser can be re-loaded by turning the key 16 and disc plate 30 in the opposite direction by an amount sufficient to withdraw the disc plate from the interior of the housing and until it becomes disengaged from the threaded walls of the housing. The empty bag can be removed through the open bottom side of the housing and replaced by a refiller, after which the operation as previously described can be repeated for utilization.

In the modification shown in FIG. 2, the same concepts are employed except that the entire body portion of the housing 12 is formed to spiral or threaded shape to provide spiral or threaded grooves through the interior of the housing for camming engagement with the disc plate for axial displacement responsive to turning movement. In this instance, the spiral grooves can be spaced farther apart for increased axial movement of the disc plate per revolution. In addition, the corrugated side walls function as spring-like members operative constantly, resiliently to urge the bottom wall 30 into pressure engagement with the bag. The element shown in broken lines in FIG. 2 represents the container 50 for the refiller, which container can be used as a ram to effect upward displacement of the bottom wall 30 or push plate 46 in FIG. 3.

A different modification is shown in FIG. 3 wherein, instead of spiral grooves or threads, the interior wall of the housing 12 is formed with longitudinally spaced rack teeth 40 having a flattened upper surface 42 and bottom surfaces 44 which taper downwardly and outwardly gradually to the housing wall.

In this modification the disc plate 46 is in the form of a push plate having resilient arms 48 which extend outwardly for a distance to overlap the flattened top surfaces 42 of the rack teeth 40 and preferably into contact with the inner walls of the housing. It is desirable to provide such rack teeth as annular ribs which extend continuously all around the interior wall of the housing in longitudinally spaced relation so that the teeth will be continuously engaged by the arms 48 independently of the rotational position of the disc plate.

In operation, the filled bag 18 is loaded into the interior of the housing followed by the disc plate 46 which is axially displaced by an amount to engage the lowermost of the rack teeth 40 to latch the plate in position of use as a bottom closure.

In this condition, the loaded dispenser can be packaged, shipped displayed, and stored with the content material in a pressurized state.

When it is desired to dispense the content material, the disc plate 46 is pushed either by hand or by means of a suitable push tool or rod for axial displacement into the body portion of the container. By reason of the tapered surfaces, the arms can override the rack teeth to enable displacement of the disc plate in one direction into the interior of the housing, while the upwardly facing surfaces 42 of the rack teeth function as stops to prevent retrograde movement of the disc plate. Thus the plate 46 can forcibly be displaced into the housing into pressing engagement with the bag 18 to pressurize the fluid or paste contained therein. Under these conditions, fluid or paste can be dispensed by the valve 14 until the dispensing pressure falls off.

Repressurizing can be simply effected in response to further axial displacement of the disc plate 46 into the housing until it reaches its upper position of adjustment, at which point the content material should be exhausted from the bag and the rack teeth terminated.

In this modification, the disc plate remains entrapped within the housing so that it becomes a single-use dispenser, incapable of being refilled as in the previous modification.

It will be understood that changes may be made in the details of construction, arrangement, and operation, without departing from the spirit of the invention, especially as defined in the following claims. For example, the housing may be formed with a separate closure which may be secured as by screwing, soldering, or the like into the top end of the housing as a top wall, with the dispensing valve pre-assembled therein.

I claim:

1. In a bag type fluid and paste dispenser comprising a rigid housing which is open at the bottom end and which is adapted to be held by the hand, a collapsible sealed bag which contains a fluid or paste material to be dispensed dimensioned to be received in the housing, a closure on the upper end of the housing, a hollow tubular member extending into the interior of the housing for piercing the bag when in position of use to communicate the fluid or paste with a dispensing valve, and means for pressurizing the fluid and paste material within the bag comprising a disc member dimensioned to be received in a telescoping relation within the open end of the housing adjacent the bottom side for displacement of the disc member relative to the housing and the bag through the housing into and out of engagement with the bag to effect pressurization of the contact material within the bag, means for actuation of the disc member for movement relative to the housing, and an operative connection between the disc member and the walls of the housing for restraining the disc member in position to which it is displaced within the housing, in which the operative connection between the disc member and the walls of the housing comprises rack teeth extending inwardly from the inner walls of the housing through a substantial length of the housing, said disc member being dimensioned to have a width slightly greater than the distance between the crests of the rack teeth on opposite sides of the housing whereby the edges of the disc member are resiliently deflected responsive to engagement with the rack teeth during displacement inwardly through the housing and are restrained by the rack teeth from displacement in the opposite direction.

2. A dispenser as claimed in claim 1 in which the rack teeth are formed with flat walls facing upwardly towards the closure with the trailing portions tapering inwardly to crests to provide a cam surface for resiliently deflecting the disc member during movement thereover until it clears the crest.

* * * * *